US006257699B1

(12) United States Patent
Tracy et al.

(10) Patent No.: US 6,257,699 B1
(45) Date of Patent: Jul. 10, 2001

(54) MODULAR CARRIAGE ASSEMBLY FOR USE WITH HIGH-SPEED, HIGH-PERFORMANCE, PRINTING DEVICE

(75) Inventors: Mark David Tracy; Ashok T. Patel, both of Monroe; Scott Alan Reese, Ontario; Tom Cross, Monroe; David Mantell, Monroe; Lisa DeLouise, Monroe; Donald John Drake, Monroe; Sophie V. Vandebroek, Monroe; Uldis Klavsons, Monroe; Clifford Lloyd George, Livingston, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/425,103

(22) Filed: Oct. 13, 1999

(51) Int. Cl.[7] ..... B41J 2/145; B41J 2/15; B41J 2/14; B41J 2/16

(52) U.S. Cl. ..... 347/40; 347/49

(58) Field of Search ..... 347/40, 49, 65

(56) References Cited

U.S. PATENT DOCUMENTS

| | | | | |
|---|---|---|---|---|
| 4,179,620 | | 12/1979 | Agulnek | 250/566 |
| 4,357,614 | | 11/1982 | Tamai | 347/47 |
| 4,922,271 | | 5/1990 | Nilsson et al. | 347/39 |
| 4,940,996 | | 7/1990 | Paton et al. | 347/42 |
| 5,079,571 | | 1/1992 | Eriksen | 347/43 |
| 5,455,610 | | 10/1995 | Harrington | 347/43 |
| 5,469,199 | | 11/1995 | Allen et al. | 347/42 |
| 5,602,574 | * | 2/1997 | Williams | 347/43 |
| 5,724,079 | | 3/1998 | Helinski et al. | 347/43 |
| 5,742,304 | | 4/1998 | Richtsmeier et al. | 347/40 |
| 5,754,198 | | 5/1998 | Nishikawa | 347/43 |
| 5,767,873 | | 6/1998 | Rogers et al. | 347/40 |
| 5,790,149 | | 8/1998 | Abe et al. | 347/40 |
| 5,793,392 | | 8/1998 | Tschida | 347/40 |
| 5,818,476 | | 10/1998 | Mey et al. | 347/40 |
| 6,079,824 | * | 6/2000 | Gotoh | 347/100 |

FOREIGN PATENT DOCUMENTS 0 595 658 A2 5/1994 (EP) .

* cited by examiner

*Primary Examiner*—Thinh Nguyen
(74) *Attorney, Agent, or Firm*—Fay, Sharpe, Fagan, Minnich & McKee, LLP

(57) ABSTRACT

A printing device having a print carriage assembly that reduces a carriage excursion along a carriage scan axis and/or reduces a width of a printing flat zone along a media feed axis, is disclosed. The print carriage assembly has a frame that traverses across a media along a carriage scan axis. The media travels along a media feed axis that is substantially perpendicular to the carriage scan axis. A first print cartridge subassembly includes a first base secured to the frame and a plurality of first print elements secured to the first base. Each of the first print elements includes a first nozzle array for ejecting an ink composition. The plurality of first print elements are spaced apart along the carriage scan axis and are offset along the media feed axis. A second print cartridge subassembly includes a second base secured to the frame and a plurality of second print elements secured to the second base. Each of the second print elements have a second nozzle array for ejecting an ink composition. The plurality of second print elements are spaced apart along the carriage scan axis and are offset along the media feed axis. The print carriage assembly reduces a carriage excursion along a carriage scan axis and/or reduces a width of a printing flat zone along a media feed axis.

26 Claims, 13 Drawing Sheets

FIG. 10
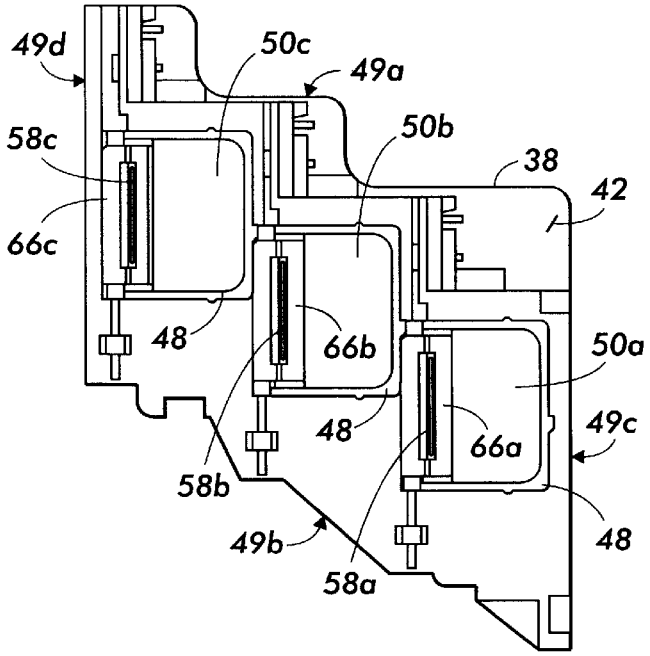
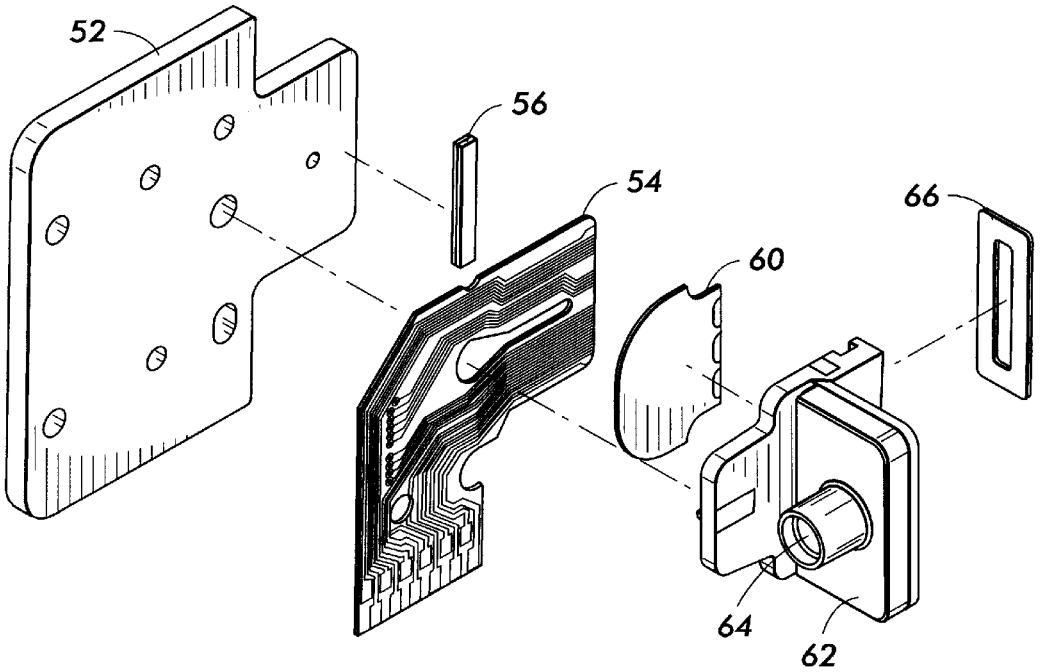
FIG. 11

MODULAR CARRIAGE ASSEMBLY FOR USE WITH HIGH-SPEED, HIGH-PERFORMANCE, PRINTING DEVICE

BACKGROUND OF THE INVENTION

The present invention relates to the printer arts. It finds particular application in conjunction with a modular carriage assembly for a high-speed, high-performance ink jet printer and will be described with particular reference thereto. However, it should be appreciated that the present invention may also find application in conjunction with other types of printing devices and applications where a print carriage traverses across a media.

FIG. 1 illustrates an exemplary printing device 1, such as an ink jet printer. The device 1 includes a frame 2 housing a media transport assembly 4. The media transport assembly feeds a media 6, such as individual sheets or continuous rolls of paper through a printing flat zone, designated generally as 8, in a first direction along a media feed axis X. A carriage assembly 10 is driven by drive means such as a motor (not shown) transversely across the printing flat zone on one or more guide rails 12 in both directions along a carriage scan axis Y.

A controller 14 controls the operation of the media transport assembly 4 and the carriage assembly 10 to cause ink to be printed or otherwise deposited on the media 6 from one or more arrays of print nozzles or jets that are associated with the carriage assembly 10, as the media is advanced in a direction along the media feed axis X.

FIG. 2 shows one configuration for the carriage assembly 10 that incorporates multiple print nozzle arrays 16*a*–16*f*. Each of the nozzle arrays 16*a*–16*f* are spaced-apart in a side-by side configuration along the carriage scan axis Y. Further, coincident pairs of the nozzle arrays 16*a* and 16*d*, 16*b* and 16*e*, and 16*c* and 16*f* are staggered or offset relative to each other along the media feed axis X. This side-by-side configuration provides a small "printing flat zone", defined as the distance 18 between the leading edges of nozzle arrays 16*a* and 16*d* and the trailing edges of nozzle arrays 16*c* and 16*f* in a media feed or x-direction. However, this side-by-side configuration disadvantageously provides for a large distance 20 between the leftmost nozzle array 16*a* and the rightmost nozzle array 16*f*, resulting in a greater overscan inefficiency of the printer.

Overscan efficiency is a measure of carriage stroke or excursion relative to media (i.e. paper) width. The greater the distance that the carriage must travel during each excursion across the media, the greater the size or form factor that the printing device must be in order to accommodate a carriage with such an excursion. Further, the configuration of FIG. 2 results in a larger carriage assembly form factor in order to accommodate the side-by-side nozzle array configuration.

FIG. 3 shows another configuration for the carriage assembly 10 that incorporates multiple print nozzle arrays 16. In particular, the nozzle arrays 16 are oriented in a stacked configuration along the media scan X-axis. That is, each of the nozzle arrays 16*a*–16*f* are staggered or offset relative to each other along the media feed axis X. Further, coincident pairs of the nozzle arrays 16*a* and 16*d*, 16*b* and 16*e*, and 16*c* and 16*f* are spaced-apart along the carriage scan axis Y. This stacked configuration advantageously provides a smaller distance 20 between the leftmost nozzle arrays 16*a* and 16*d* and the rightmost nozzle arrays 16*c* and 16*f* when compared to the side-by-side configuration of FIG. 2.

The reduced distance 20 advantageously provides for reduced overscan inefficiency. However, the stacked configuration disadvantageously provides an increased printing flat zone 18, when compared to the side-by-side configuration of FIG. 2. The greater the width of the printing flat zone, the greater the size that the printing device must be in order to accommodate the printing flat zone. Further, the carriage assembly configuration of FIG. 3 results in a larger carriage form factor in order to accommodate the stacked nozzle assembly configuration.

Accordingly, it has been considered desirable to develop a new and improved carriage assembly for a high-speed, high-performance, printing device that meets the above-stated needs and overcomes the foregoing difficulties and others while providing better and more advantageous results.

SUMMARY OF THE INVENTION

In accordance with one aspect of the present invention, a printing device is disclosed. The printing device includes a print carriage assembly having a frame that traverses across a media along a carriage scan axis. The media travels along a media feed axis that is substantially perpendicular to the carriage scan axis. A first print cartridge subassembly includes a first base secured to the frame and a plurality of first print elements secured to the first base. Each of the first print elements includes a first nozzle array for ejecting an ink composition. The plurality of first print elements are spaced apart along the carriage scan axis and are offset along the media feed axis. A second print cartridge subassembly includes a second base secured to the frame and a plurality of second print elements secured to the second base. Each of the second print elements have a second nozzle array for ejecting an ink composition. The plurality of second print elements are spaced apart along the carriage scan axis and are offset along the media feed axis.

In accordance with another aspect of the present invention, a print carriage assembly is disclosed. The print carriage assembly includes a frame, and a first print cartridge subassembly including a first base secured to the frame and a plurality of first print elements secured to the first base. Each of the first print elements includes a first nozzle array adapted to eject an ink composition. The plurality of first print elements are spaced apart along a carriage scan axis and are offset along a media feed axis. A second print cartridge subassembly includes a second base secured to the frame and a plurality of second print elements secured to the second base. Each of the second print elements have a second nozzle array adapted to eject an ink composition. The plurality of second print elements are spaced apart along the carriage scan axis and are offset along the media feed axis.

One advantage of the present invention is the provision of a printing device having a print carriage assembly that reduces a carriage excursion along a carriage scan axis and/or reduces a width of a printing flat zone along a media feed axis.

Another advantage of the present invention is the provision of a printing device having a carriage assembly with a plurality of modular, substantially identical, print cartridge subassemblies removably mounted to the carriage.

Yet another advantage of the present invention is the provision of a carriage assembly having a plurality of modular, substantially identical, print cartridge subassemblies removably mounted thereto.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment(s) and are not to be construed as limiting the invention.

FIG. 10 is a bottom plan view of the print cartridge subassembly of FIG. 7;

FIG. 11 is an exploded view of a print element associated with the print cartridge subassembly of FIGS. 7–10;

DETAILED DESCRIPTION OF THE PREFERRED EMBODIMENT(s)

Figure 1:
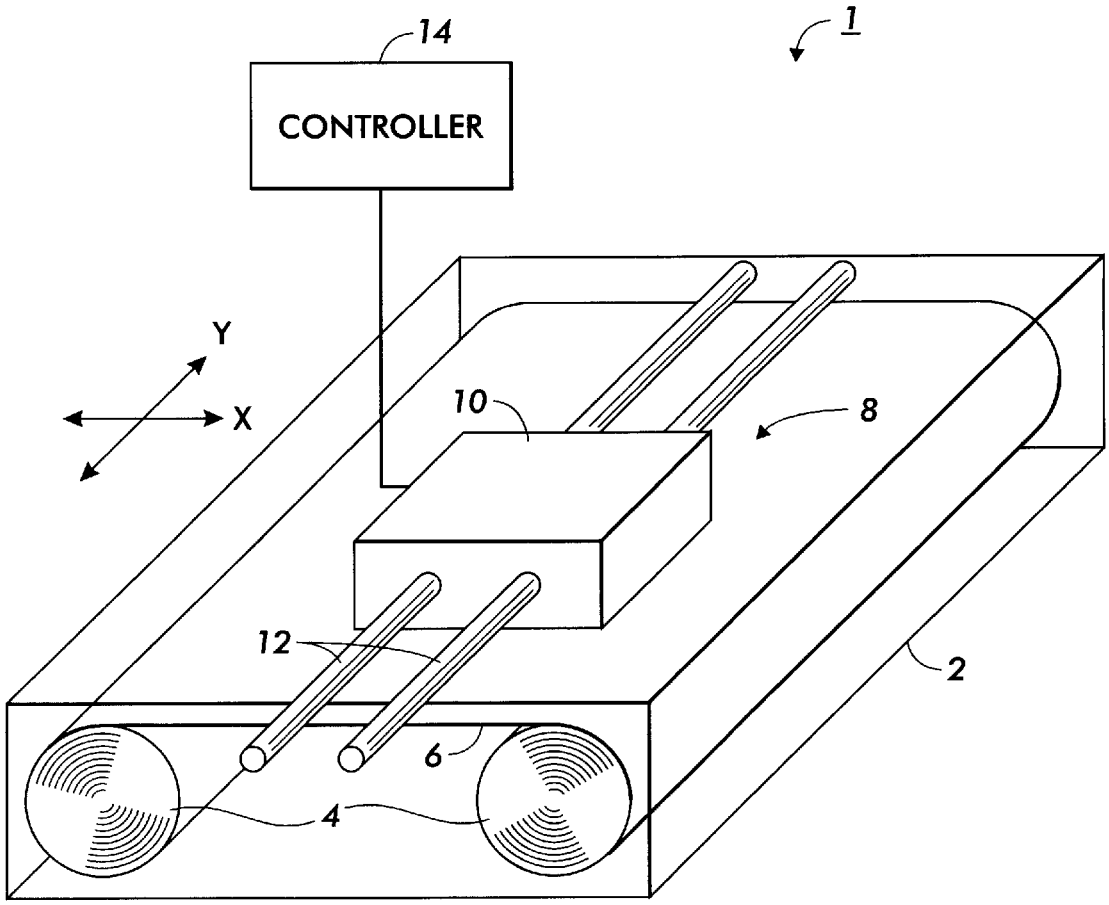
FIG. 1 is a diagrammatic view of an exemplary printing device that incorporates a print carriage assembly.
Figure 2:
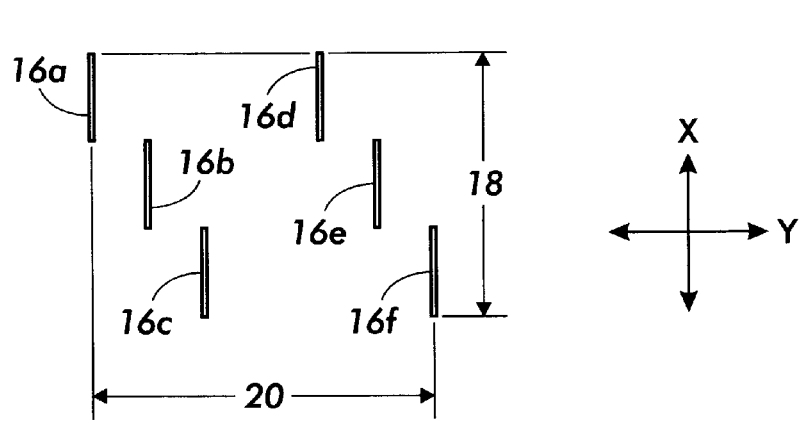
FIG. 2 is a plan view of one nozzle array configuration for the print carriage assembly of FIG. 1.
Figure 3:
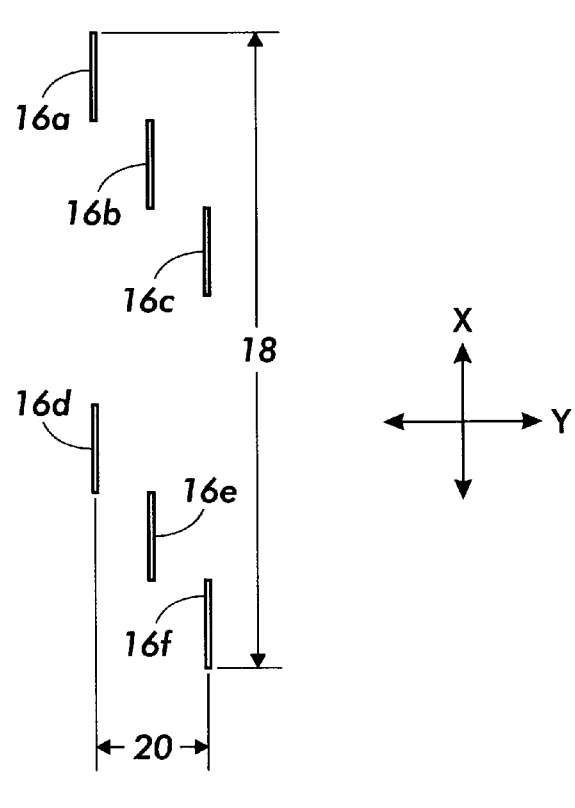
FIG. 3 is a plan view of another nozzle array configuration for the print carriage assembly of FIG. 1.
Figure 4:
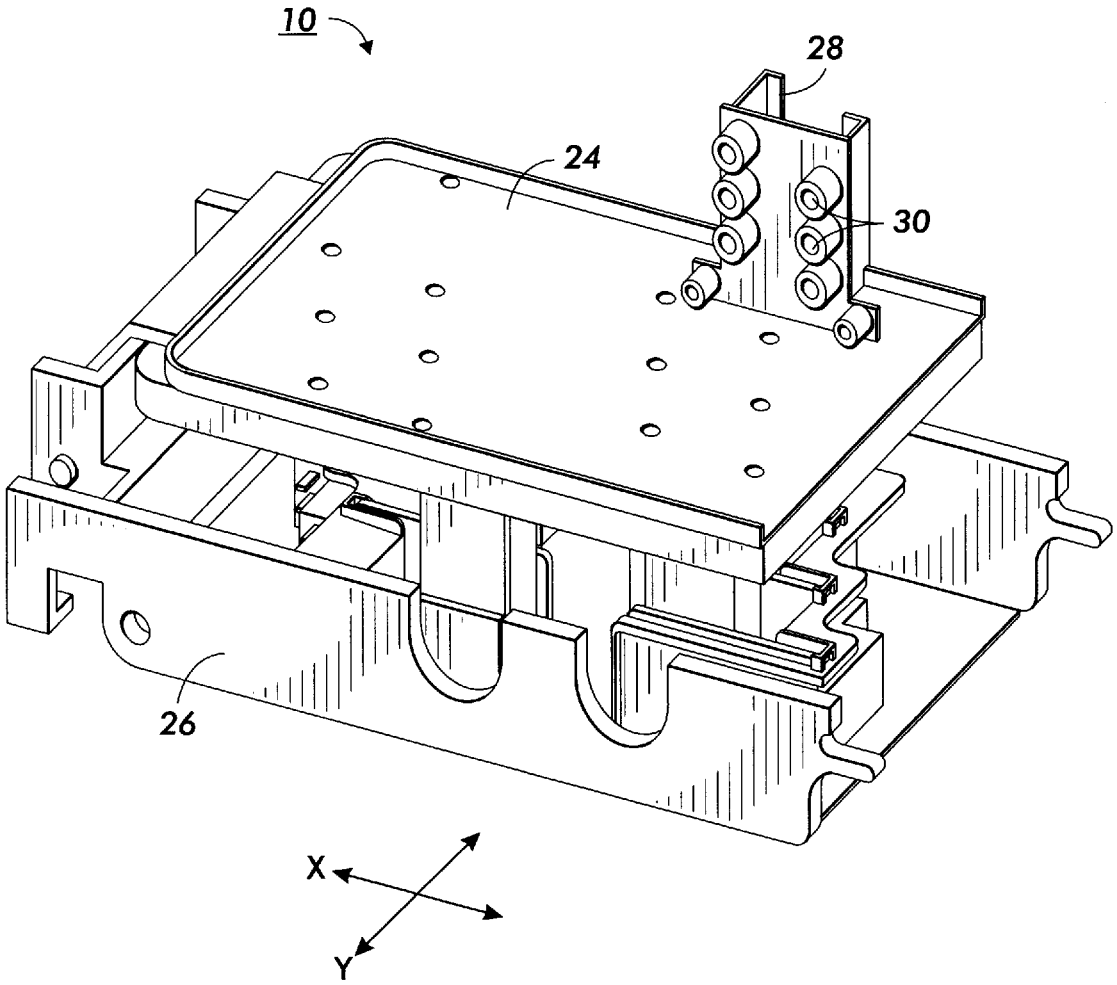
FIG. 4 is a perspective view of an exemplary print carriage assembly associated with the printing device of FIG. 1.
Figure 5:
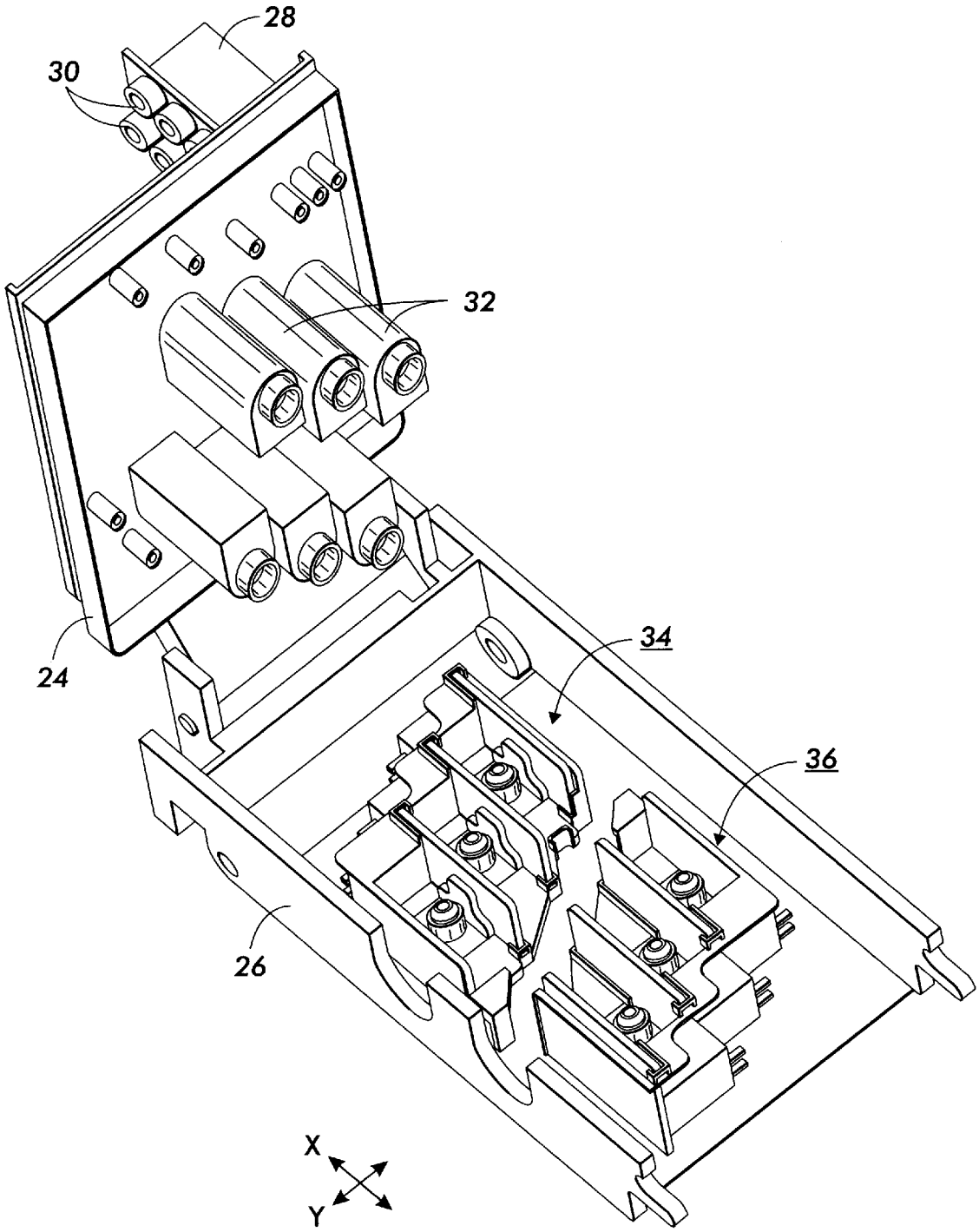
FIG. 5 is a perspective view of the print carriage assembly of FIG. 4 opened to show two modular print cartridge subassemblies of the present invention.
Figure 6:
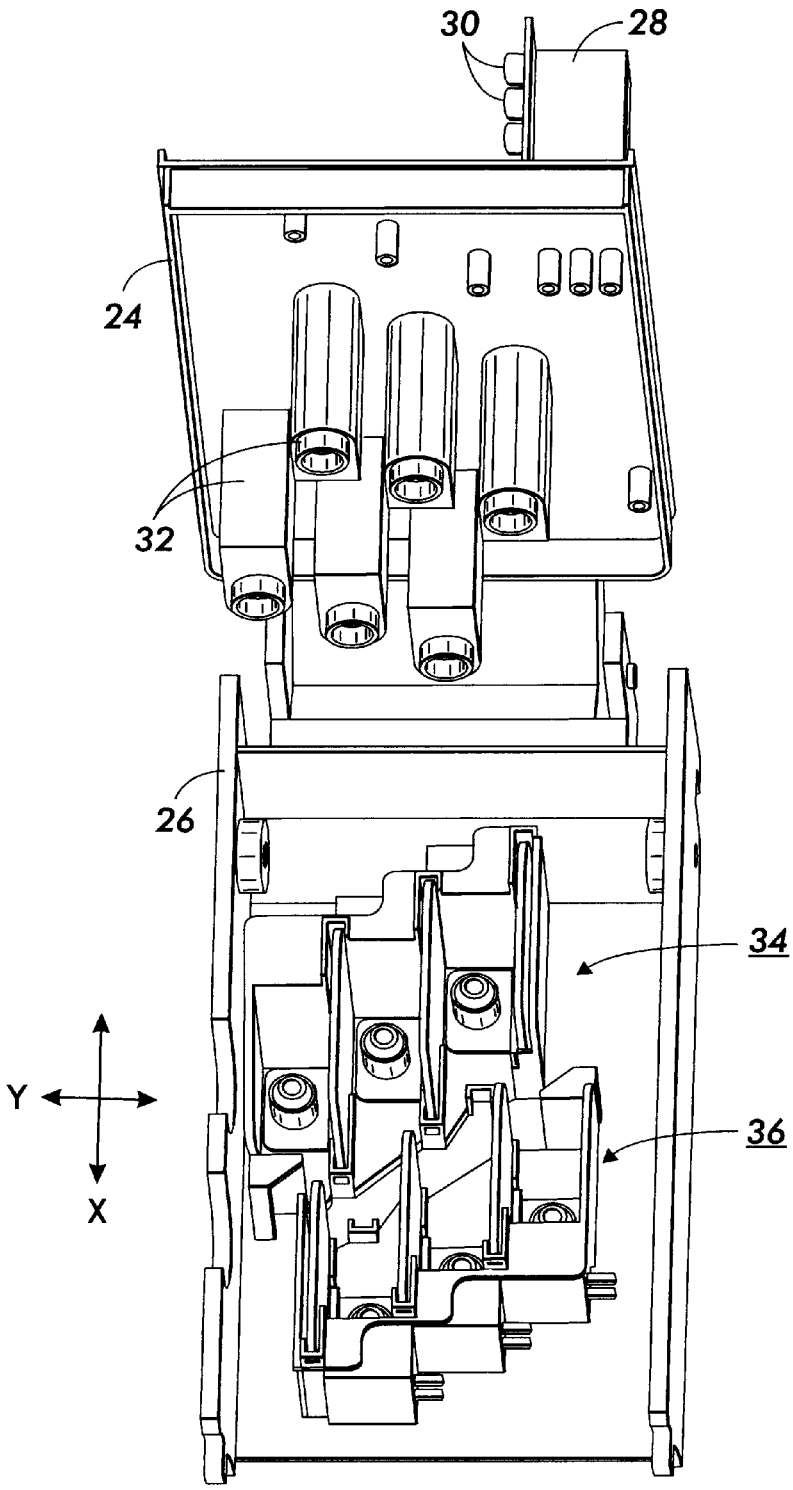
FIG. 6 is a different perspective view of the opened print carriage assembly of FIG. 4.
Figure 7:
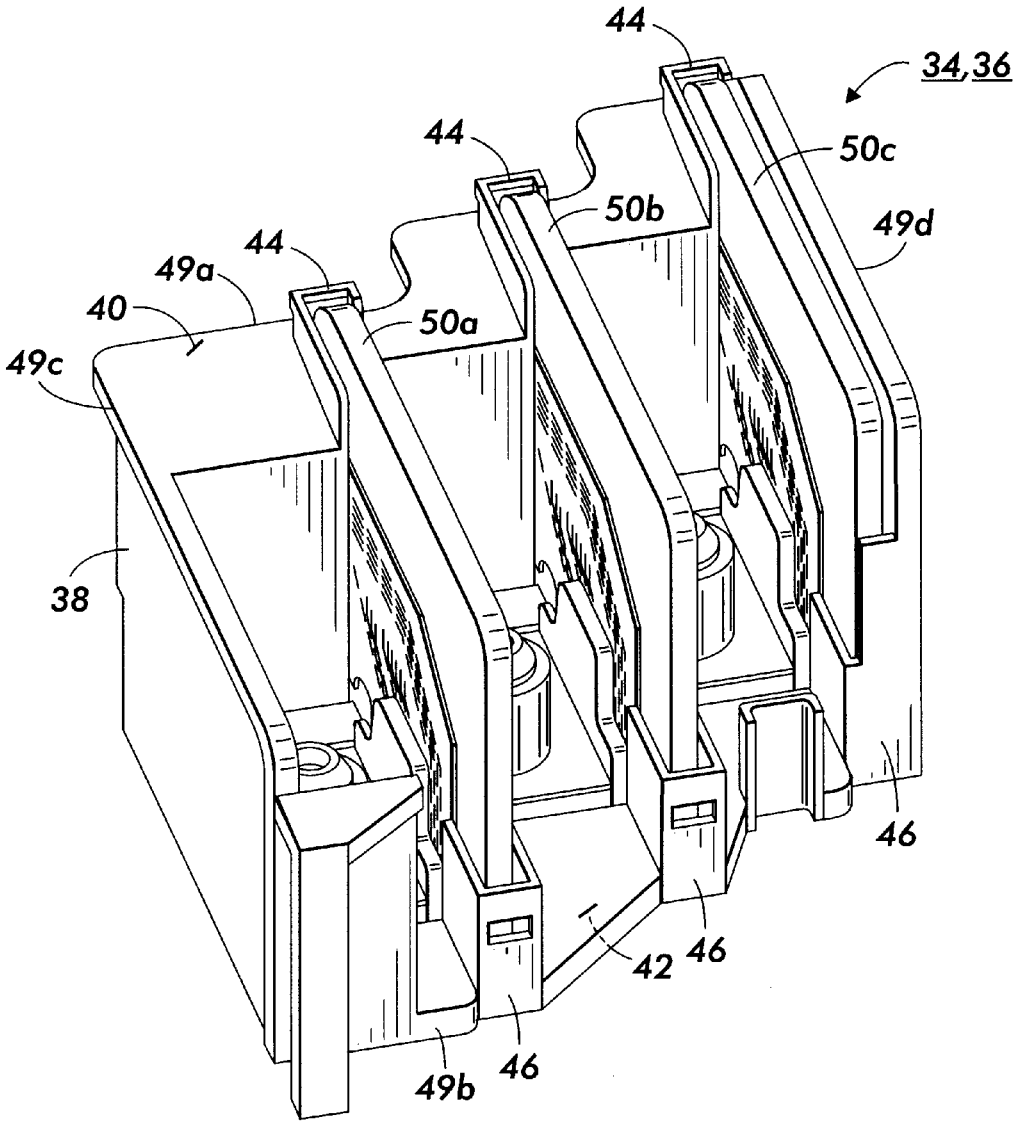
FIG. 7 is a perspective view of a modular print cartridge subassembly shown in FIGS. 5 and 6.

Referring now to FIGS. 4–6, an exemplary configuration for the carriage assembly 10 includes an upper shell or frame portion 24 that is attached (e.g. pivotally) to a lower shell or frame portion 26. The upper frame portion 24 includes an ink manifold 28 secured to an outer surface of the frame portion. The ink manifold 28 includes a number of first ink ports 30. A number of subtanks 32 are secured to an under surface of the frame portion. The ink ports 30 communicate with the subtanks 32. Ink is supplied to the ink ports 30 and subtanks 32 from ink supply lines or umbilicals connected to off-head primary ink supply tanks (not shown).

A first modular print cartridge subassembly 34 and a second modular print cartridge subassembly 36 are each removably secured to each other (i.e. interlocked together) and/or to the lower frame portion 26 by positive locking means such as a snap-fit arrangement and/or screws, or the like. The first and second modular print cartridge subassemblies 34, 36 are substantially identical to each other. That is, the subassemblies are manufactured in substantially the same manner with substantially the same components.

It is contemplated that an alignment mechanism may be employed to align the first print cartridge subassembly 34 to the second print cartridge subassembly 36 during installation. It is also contemplated that an adjustment mechanism may be employed for adjusting the position of one (or both) of the subassemblies relative to each other either during or following the manufacturing process.

Referring now to FIGS. 7–10, each subassembly 34, 36 includes a base or frame 38 having a top wall 40 and a bottom wall 42. The top wall includes a number of guide portions 44. The bottom wall includes an equal number of guide portions 46. The bottom wall also includes a number of contoured apertures 48 (FIGS. 8 and 10) therethrough. Alternatively, the apertures 48 may be joined together to form a single contoured aperture. A first edge 49*a* and a second edge 49*b* of the frame 38 are oriented generally diagonally relative to the side edges 49*c*, 49*d*.

A plurality of individual print elements 50*a*–50*c* are mounted to the frame 38 such that a lower portion of each print element 50 extends through the contoured aperture(s) 48. Corresponding guide portions 44 and 46 cooperate to position the print elements 50*a*–50*c* relative to the frame 38.

The print elements 50*a*–50*c* are substantially identical to each other. That is, the print elements are manufactured in substantially the same manner with substantially the same components. The print elements 50*a*–50*c* are fixedly secured to the frame 38, such as by an adhesive applied between the guide portions and the respective print elements.

It is contemplated that an alignment mechanism can be employed to align the print elements with respect to each other and/or with respect to the frame 38. It is also contemplated that an adjustment mechanism may be employed for adjusting the position of at least one of the print elements relative to at least one of the other print elements either during or following the manufacturing process. For instance, it is contemplated that a first print element can be aligned relative to a second print element by aligning at least a first nozzle associated with the first print element relative to a corresponding second nozzle associated with the second print element.

Figure 8:
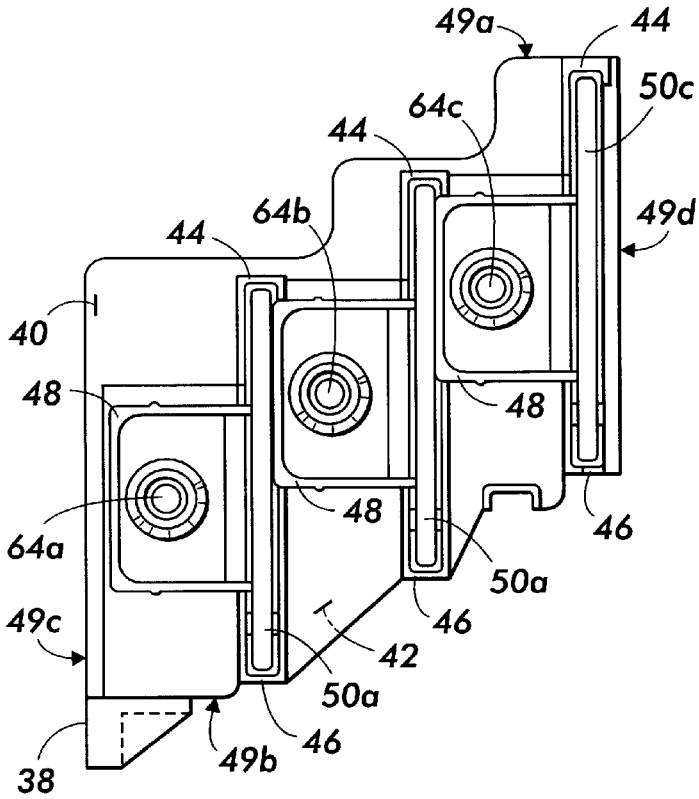
FIG. 8 is a top plan view of the print cartridge subassembly of FIG. 7.
Figure 9:
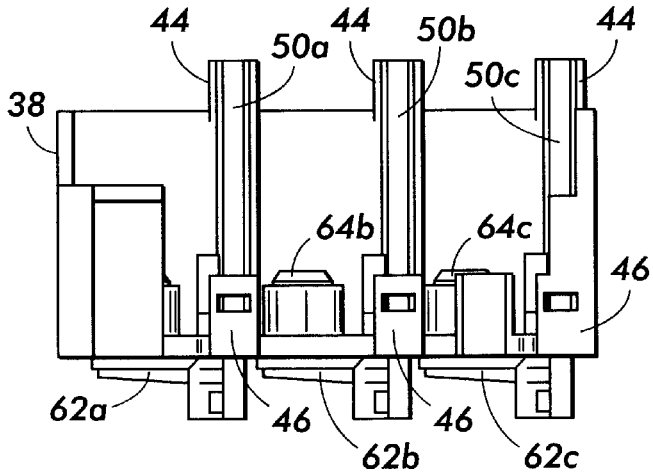
FIG. 9 is a side elevation view of the print cartridge subassembly of FIG. 7.

As best shown in FIGS. 8 and 10, the print elements are spaced substantially evenly apart from each other along the carriage scan axis Y. In addition, the print elements are staggered or offset relative to each other along the media feed axis X. That is, print element 50*b* overlaps print element 50*a* along the media feed axis X, and print element 50*c* overlaps a print element 50*b* along the media feed axis X. By staggering the print elements along the media feed axis X within a subassembly, ink pooling artifacts can be reduced because on any given pass of the carriage across the media only one print element can eject ink at a given location on the media.

With continuing reference to FIGS. 7–10, and particular reference to FIG. 11, each of the print elements 50 includes a heat sink 52. A printed wire board 54 is secured (e.g. adhesively bonded) to one side of the heat sink. A thermal ink jet (TIJ) die module 56 is bonded to the heat sink. Wire bonds are used to form electrical connections between the TIJ die module and the contact pads associated with the printed wire board. The TIJ die module 56 is typically formed from a base layer of silicon having a plurality of ink channels, heater pads, and electrical interconnects formed therein. A top layer of silicon is bonded to the base layer to form a TIJ die module having an array of ink jet nozzles 58 (FIG. 10). In the embodiment being described, there are 320 nozzles or jets in each TIJ die module 56, resulting in 319 substantially equidistant pitches between the nozzles or jets.

A fluid seal 60 is interposed between the TIJ die module 56 and a fluid manifold 62. The fluid manifold 62 includes a second ink port 64 that communicates with one of the subtanks 32 (FIGS. 5 and 6) when the carriage upper frame portion 24 and lower frame portion 26 are joined together as shown in FIG. 4. A face plate 66 surrounds the nozzle array 58. The face plate provides a mating surface for a fluid sealing member associated with a conventional ink jet maintenance station when the printing device 10 is not in operation.

Figure 12:
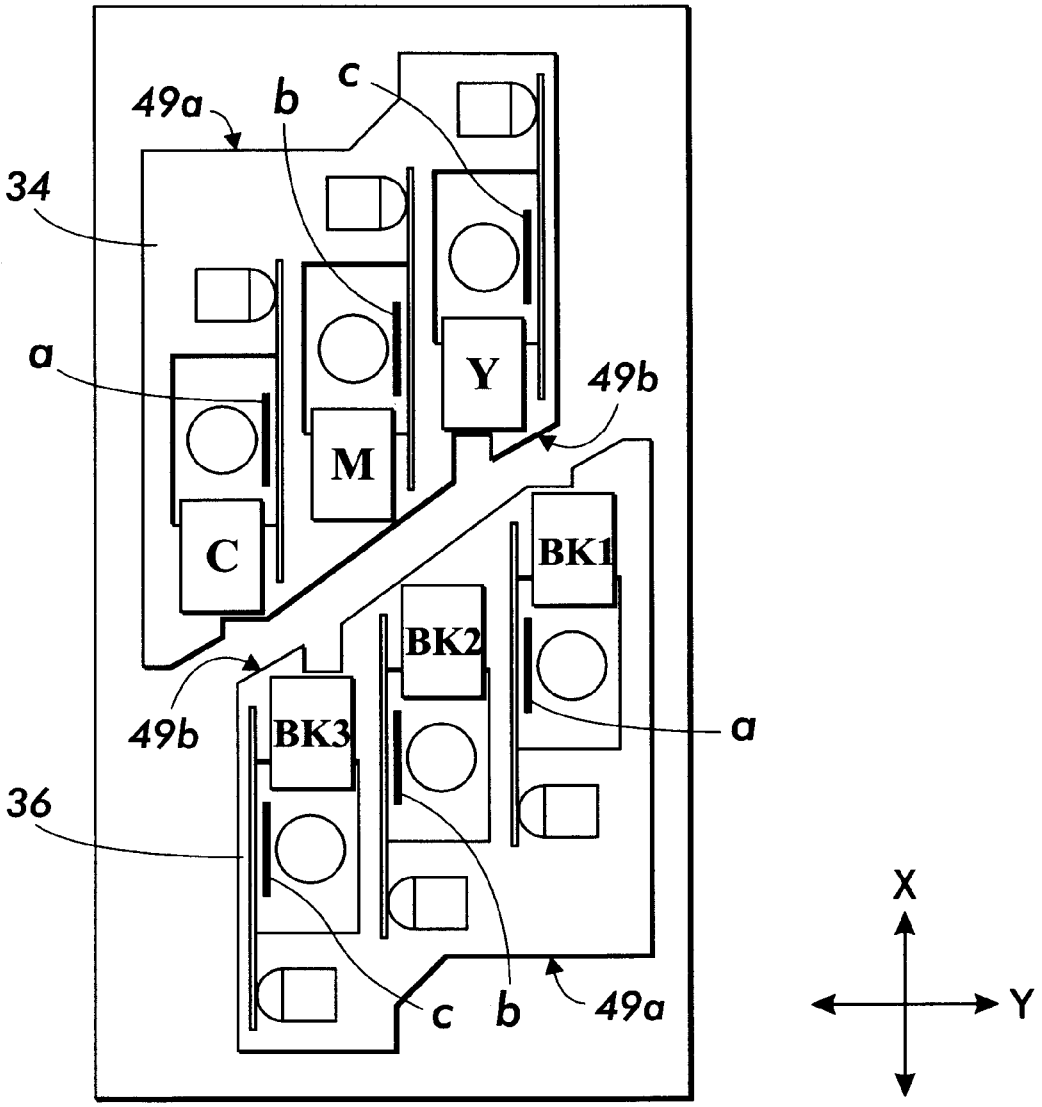
FIG. 12 is a diagrammatic view showing a layout for two modular print cartridge subassemblies positioned within the print carriage assembly of FIGS. 4–6.

Referring now to FIG. 12, the first and second print cartridge subassemblies 34, 36 are arranged in a nested, mutually opposed, configuration to reduce the overall length and width dimensions or footprint of the carriage assembly 10. That is, the subassemblies face each other such that the edges 49*b* of the print cartridge subassemblies 34, 36 are adjacent to each other, and the edges 49*a* are remote from each other. The diagonal orientation of the edges 49*b* facilitate overlapping the subassemblies 34, 36 along both the media feed axis X and the carriage scan axis Y.

Figure 13:
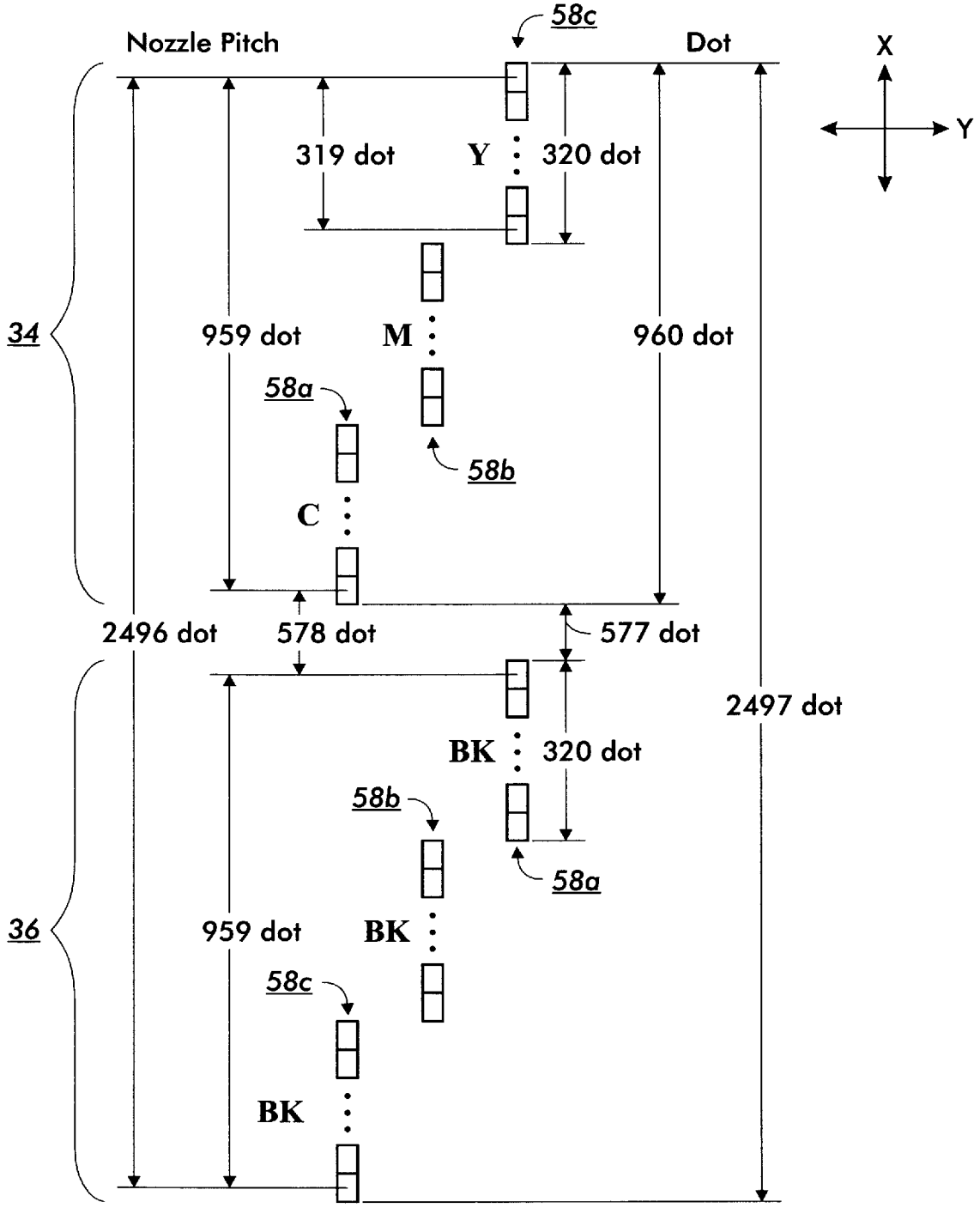
FIG. 13 is a diagrammatic view showing a layout of the nozzle arrays associated with the print cartridge subassemblies of FIG. 12.

With reference to FIG. 13, notwithstanding the fact that the subassemblies 34, 36 overlap along the media feed axis X and the carriage scan axis Y (FIG. 12), pairs of nozzle arrays 58 of the subassemblies 34 and 36 are coincident along the carriage scan axis Y. That is, nozzle array 58*a* of subassembly 34 is coincident with nozzle array 58*c* of subassembly 36 along the Y-axis, nozzle array 58*b* of subassembly 34 is coincident with nozzle array 58*b* of subassembly 36 along the Y-axis, and nozzle array 58*c* of subassembly 34 is coincident with nozzle array 58*a* of subassembly 36 along the Y-axis. This coincidence of pairs of the nozzle arrays along the Y-axis reduces the overscan inefficiency of the carriage assembly 10 because the distance that the carriage assembly travels in order for the nozzle arrays to traverse completely across the media is reduced. Reducing the extent of carriage excursion increases the printing speed of the printing device 1 and also decreases the size of the printing device 1.

With continuing reference to FIG. 13, the end nozzle of the arrays 58*a* of each subassembly 34, 36 are spaced from the end nozzle of the respective nozzle arrays 58*b* by a distance equal to one nozzle pitch along the media feed axis X. Likewise, the end nozzle of the nozzle arrays 58*b* are spaced from the end nozzle of the respective nozzle arrays 58*c* by a distance equal to one nozzle pitch along the media feed axis X. Further, the nozzle array 58*a* of subassembly 34 is spaced from the nozzle array 58*a* of subassembly 36 by a distance substantially equal to 578 nozzle pitches (or 577 nozzles). Thus, i) the nozzle arrays 58*a*–58*c* of the subassembly 34 cooperate to form a first array having 960 nozzles that are equidistant along the media feed axis X, ii) the nozzle arrays 58*a*–58*c* of the subassembly 36 cooperate to form a second array having 960 nozzles that are equidistant along the media feed axis X, and iii) the first array is spaced from the second array by 577 nozzles along the media feed axis X.

Figure 14:
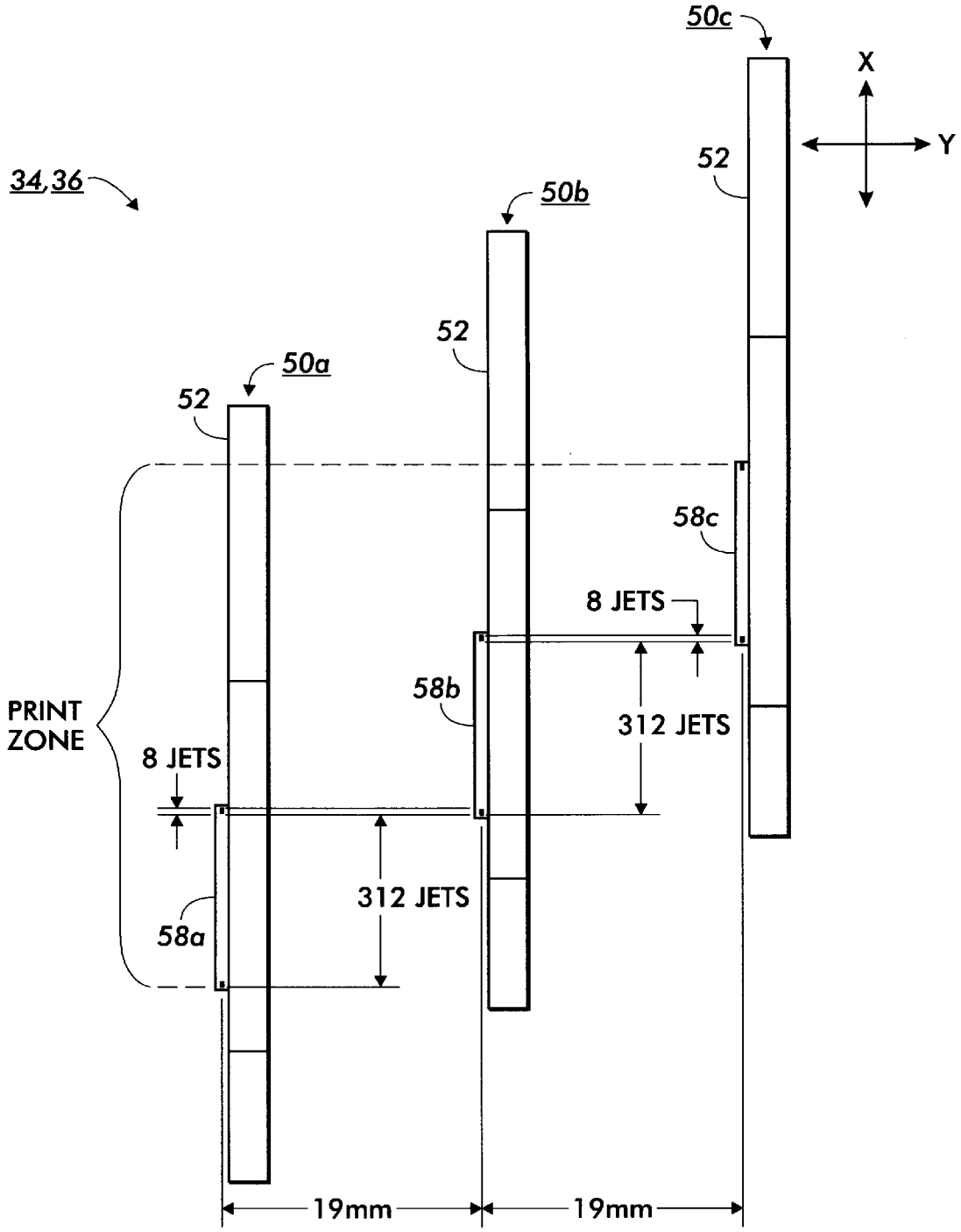
FIG. 14 is an alternate nozzle array layout for the print cartridge subassemblies of FIG. 12.

Alternatively, as shown in FIG. 14, the nozzle arrays 58*a*–58*c* of each subassembly 34, 36 can be staggered in an overlapping manner along the X-axis. In the embodiment being described, a predetermined number of nozzles (e.g. 8) of the nozzle array 58*a* are substantially coincident with a predetermined number of nozzles of the nozzle array 58*b* along the X-axis, and a predetermined number of nozzles of the nozzle array 58*b* are substantially coincident with a predetermined number of nozzles of the nozzle array 58*c* along the X-axis. It is contemplated that known nozzle alignment techniques can be utilized for course and/or fine position adjustment in one or both directions along the X-axis in order to achieve alignment along the X-axis between adjacent nozzle arrays. It is also contemplated that certain of the nozzles falling within the overlapping portions of adjacent nozzle arrays can be selectively disabled.

In either case, the subassemblies can be mechanically aligned and/or adjusted to obtain precise nozzle spacing. Alternatively, the subassemblies can be mechanically aligned and/or adjusted to obtain course nozzle spacing alignment followed by a more precise alignment step such as electronically enabling and/or disabling one or more nozzles of adjacent print elements to reduce the misalignment to less than one nozzle pitch.

Figure 15:
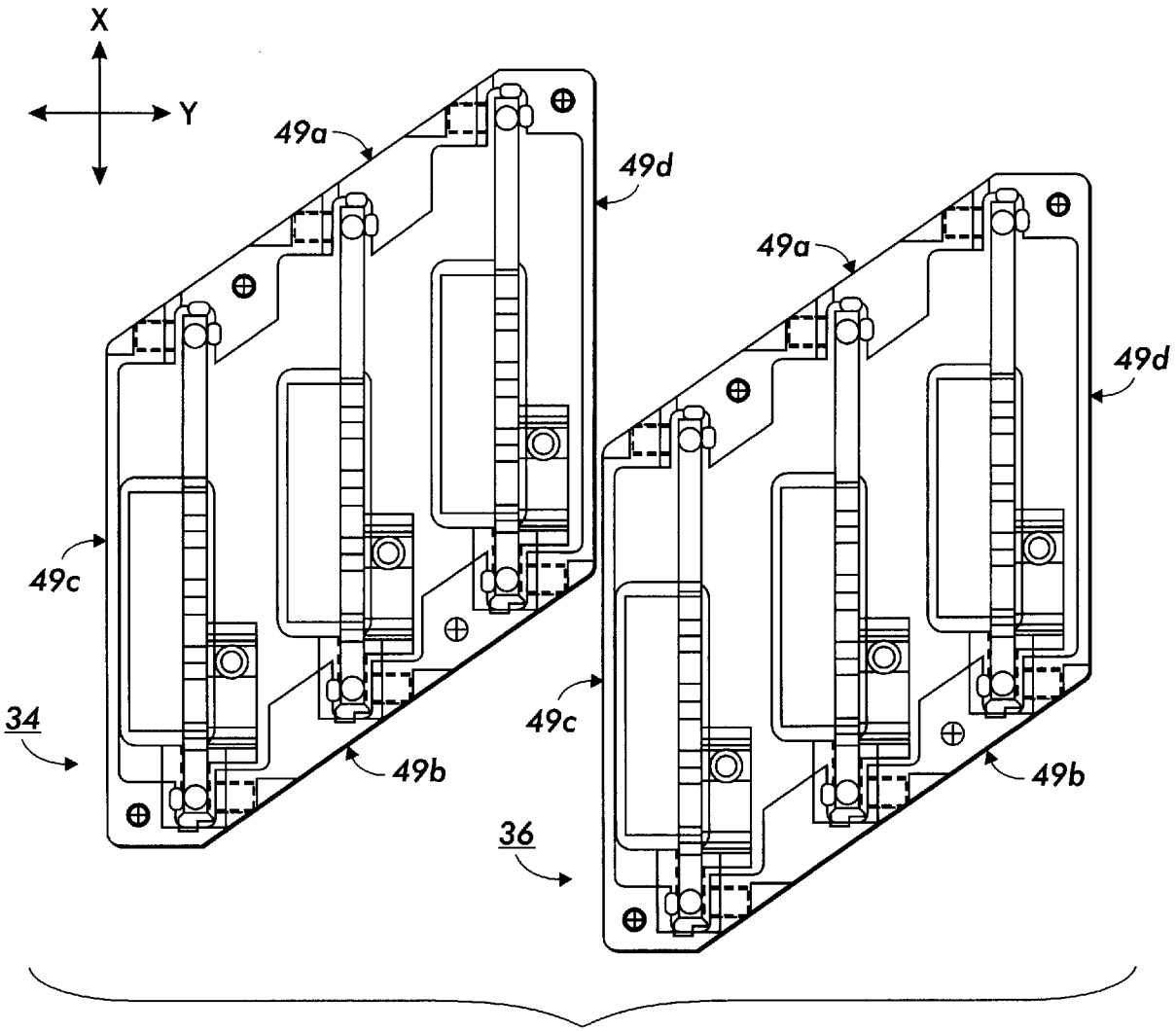
FIG. 15 is another layout for two modular print cartridge subassemblies positioned within the print carriage assembly of FIGS. 4–6.

With reference to FIG. 15, the modular print cartridge subassemblies 34, 36 of the present invention can also be arranged in a side-by-side configuration within the carriage assembly 10 to reduce the width of the printing flat zone along the X-axis. In this configuration, the subassemblies 34, 36 both face the same direction, and are spaced-apart along the carriage scan axis Y so that the edge 49*d* of the subassembly 34 is offset from the adjacent edge 49*c* of the subassembly 36 along the Y-axis. Moreover, the subassemblies 34, 36 are also staggered in an offset manner along the media feed axis X. It should be appreciated that the size and form factor of the printing device 1 can be reduced by reducing the width of the print zone along the X-axis.

Figure 16:
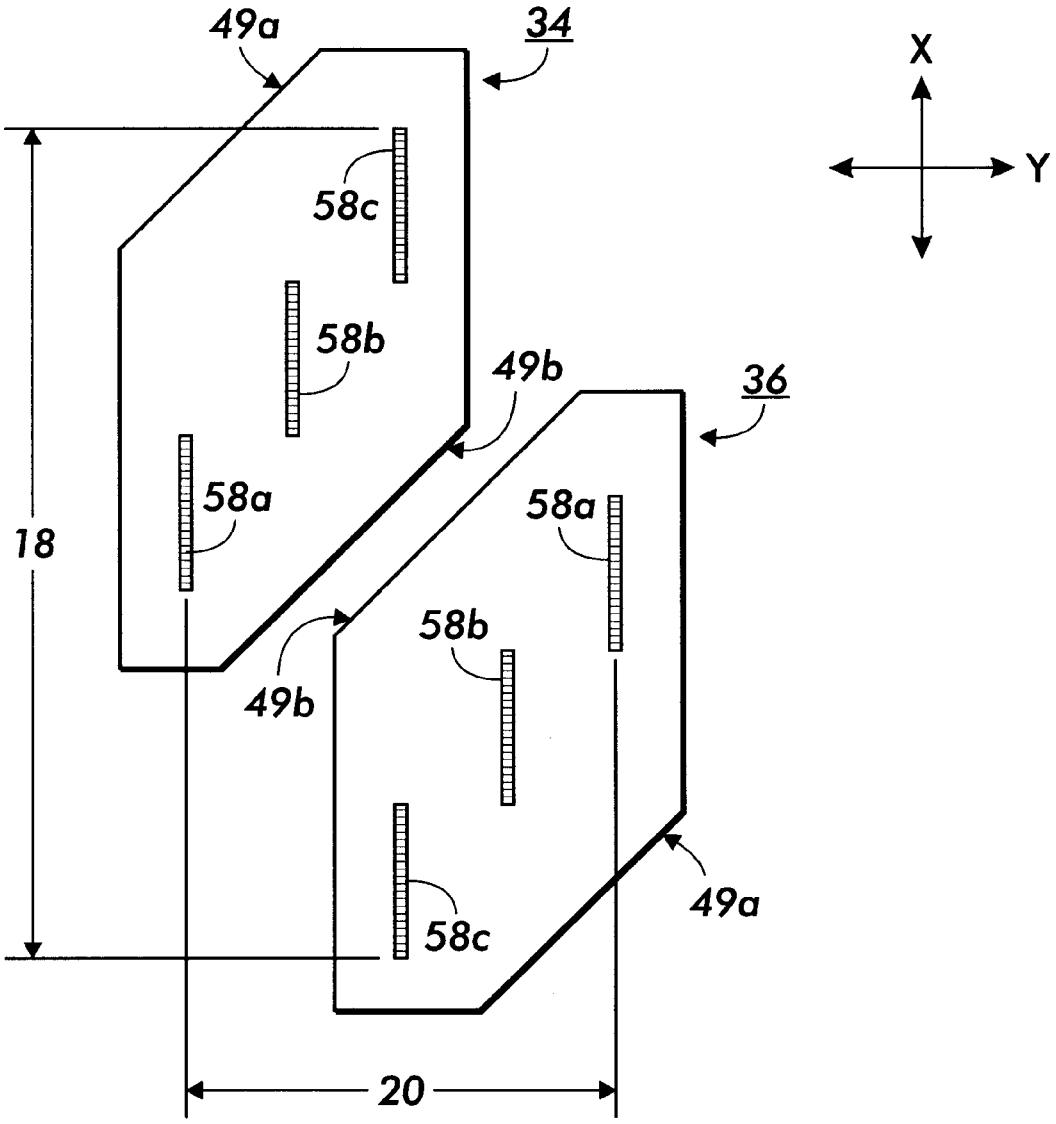
FIG. 16 is a further layout for two modular print cartridge subassemblies within the print carriage assembly of FIGS. 4–6.

With reference to FIG. 16, the modular print cartridge subassemblies 34, 36 can also be arranged in a nested, mutually-opposed, configuration to reduce i) the overscan inefficiency, and hence the distance 20 between the right-most and leftmost nozzle arrays, of the carriage assembly 10, and ii) the width 18 of the printing flat zone along the X-axis. That is, the modular print cartridge subassemblies 34, 36 are nested together so that not only do the respective subassembly frames 38 overlap along the X and Y-axes, and one or more print elements 50 of each subassembly overlap along the X and Y-axes, but so do the respective nozzle arrays 58. In particular, the frames 38 are nested together such that at least one of the nozzle arrays 58*a*–58*c* of the subassembly 34 overlaps at least one of the nozzle arrays 58*a*–58*c* of the subassembly 36 along the Y-axis, and at least one of the nozzle arrays 58*a*–58*c* of the subassembly 34 overlaps at least one of the nozzle arrays 58*a*–58*c* of the subassembly 36 along the X-axis. In the embodiment of FIG. 16, the nozzle array 58*a* of the subassembly 34 overlaps the nozzle array 58*a* of the subassembly 36 along the X-axis, and the nozzle array 58*c* of the subassembly 34 overlaps the nozzle array 58*c* of the subassembly 36 along the Y-axis.

Thus, the overscan inefficiency and the width of the printing flat zone along the X-axis are reduced.

In the described embodiments, there are two, substantially identical, print cartridge subassemblies 34 and 36. Each of the subassemblies includes three substantially identical print elements 50 fixedly secured thereto. However, it is contemplated that a carriage assembly can be configured with any number of modular print cartridge subassemblies 34, 36 with each having any number of substantially identical print elements 50 fixedly secured thereto.

Also in the embodiment being described, the print elements 50*a*–50*c* of the subassembly 34 are adapted for ejecting color inks. That is, print element 50*a* of the subassembly 34 is adapted to eject a cyan ink, print element 50*b* of the subassembly 34 is adapted to eject a magenta ink, and print element 50*c* of the subassembly 34 is adapted to eject a yellow ink. The print elements 50*a*–50*c* of the subassembly 36 are each adapted to eject a black ink. It is also contemplated that more than one print element can be used to eject a particular color of ink (e.g. cyan, magenta, yellow).

By way of example only, the printing device 10 can be operated in an exemplary multi-pass color printing mode wherein each of the color print elements 50*a*–50*c* of the subassembly 34 are enabled and capable of firing, and only one of the black print elements 50*a*–50*c* of the subassembly 36 (such as print element 50*a*) is enabled and capable of firing. The printing device 10 can also be operated in a single-pass black and white printing mode whereby each of the print elements 50*a*–50*c* of the subassembly 34 are disabled and not capable of firing, and all three of the print elements 50*a*–50*c* of the subassembly 36 are enabled and capable of firing. Further, the printing device 10 can be operated to print black in a multi-pass mode while at the same time printing color in a single pass mode.

It should be appreciated that development and manufacturing cost savings and increased productivity can be achieved by utilizing modular (i.e. standardized) carriage assembly components. Manufacturing savings can be achieved, in part, because a single manufacturing line/process can be utilized to produce components for any number of different carriage assembly configurations. Manufacturing cost savings can also be achieved because a single print element design (and hence a single manufacturing process) can be used for both color and black print elements.

A single print element design can be used to cost effectively manufacture customer or line replaceable print cartridge subassembly units (CRU/LRU) with different performance characteristics (printing speed and/or throughput increases with more print elements per subassembly). A single print element design and a single print cartridge subassembly design can be used to cost effectively manufacture carriage assemblies with different performance characteristics (printing speed and/or throughput increases with more print elements per carriage assembly). Moreover, ease of maintenance can be improved by making each subassembly a replaceable unit rather than by making each print element replaceable. Thus, complicated print element-to-print element realignment measures can be avoided within a given subassembly.

The invention has been described with reference to the preferred embodiment(s). Obviously, modifications and alterations will occur to others upon reading and understanding the preceding detailed description. It is intended that the invention be construed as including all such modifications and alterations insofar as they come within the scope of the appended claims or the equivalents thereof.

For instance, the present invention has been described with reference to an exemplary thermal ink jet printing device. However, the above-described invention is equally applicable with other types of printing technologies such as piezo or AIP (acoustic ink printing). Further, it is contemplated that ink can be supplied to the subassemblies in any manner known to those of ordinary skill in the art. Thus, individual ink supply tanks can be utilized to feed ink to the individual print elements, or ink can be drawn from the same ink supply. Ink can also be housed with the subassemblies 34, 36 rather than be housed in an off-head arrangement and connected by an umbilical as shown in FIGS. 4–6.

What is claimed is:

1. A printing device comprising:

a print carriage assembly having a frame that traverses across a media along a carriage scan axis, the media traveling along a media feed axis that is substantially perpendicular to the carriage scan axis;

a first print cartridge subassembly including a first base secured to the frame and a plurality of first print elements secured to the first base, each of the first print elements including a first nozzle array for ejecting an ink composition, the plurality of first print elements being spaced apart along the carriage scan axis and being offset along the media feed axis; and at least one second print cartridge subassembly including a second base secured to the frame and a plurality of second print elements secured to the second base, each of the second print elements having a second nozzle array for ejecting an ink composition, the plurality of second print elements being spaced apart along the carriage scan axis and being offset along the media feed axis.

2. The device of claim 1, wherein the first print cartridge subassembly is removably secured to the frame and the second print cartridge subassembly is removably secured to the frame.

3. The device of claim 2, wherein the plurality of first print elements are fixedly secured to the first print cartridge subassembly and the plurality of second print elements are fixedly secured to the second print cartridge subassembly.

4. The device of claim 1 wherein the first base is substantially identical to the second base, and the plurality of first print elements are substantially identical to the plurality of second print elements.

5. The device of claim 1, wherein the first base and the second base face the same direction.

6. The device of claim 1, wherein the first print cartridge subassembly and the second print cartridge subassembly face in the same direction.

7. The device of claim 1, wherein the plurality of first nozzle arrays each eject a black ink composition and the plurality of second nozzle arrays each eject an ink composition other than a black ink composition.

8. A printing device comprising a print carriage assembly having a frame that traverses across a media along a carriage scan axis, the media traveling along a media feed axis that is substantially perpendicular to the carriage scan axis;

a first print cartridge subassembly including a first base secured to the frame and a plurality of first print elements secured to the first base, each of the first print elements including a first nozzle array for electing an ink composition, the plurality of first print elements being spaced apart along the carriage scan axis and being offset along the media feed axis; and at least one second print cartridge subassembly including a second base secured to the frame and a plurality of second print elements secured to the second base, each of the second print elements having a second nozzle array for electing an ink composition, the plurality of second print elements being spaced apart along the carriage scan axis and being offset along the media feed axis;

wherein the first base has a first edge and a second edge, and the first edge extends at a first acute angle from the second edge; the second base has a third edge and a fourth edge, and the third edge extends at a second acute angle from the fourth edge; and the first base is positioned to face the second base such that the first edge and the third edge are substantially parallel and adjacent, and the second edge and the fourth edge are substantially parallel.

9. The device of claim 8, wherein at least a portion of the first base overlaps at least a portion of the second base along the media feed axis.

10. The device of claim 9, wherein at least a portion of the first base overlaps at least a portion of the second base along the carriage scan axis.

11. The device of claim 8, wherein at least one of the first nozzle arrays overlaps at least one of the second nozzle arrays along the media feed axis.

12. The device of claim 8, wherein at least one of the first nozzle arrays overlaps at least one of the second nozzle arrays along the carriage scan axis.

13. The device of claim 8, wherein at least one of the first nozzle arrays overlaps at least one of the second nozzle arrays along the media feed axis and at least another one of the first nozzle arrays overlaps at least another one of the second nozzle arrays along the carriage scan axis.

14. A print carriage assembly comprising:

a frame;

a first print cartridge subassembly including a first base secured to the frame and a plurality of first print elements secured to the first base, each of the first print elements including a first nozzle array adapted to eject an ink composition, the plurality of first print elements being spaced apart along a carriage scan axis and being offset along a media feed axis; and a second print cartridge subassembly including a second base secured to the frame and a plurality of second print elements secured to the second base, each of the second print elements having a second nozzle array adapted to eject an ink composition, the plurality of second print elements being spaced apart along the carriage scan axis and being offset along the media feed axis.

15. The device of claim 14, wherein the first print cartridge subassembly is removably secured to the frame and the second print cartridge subassembly is removably secured to the frame.

16. The device of claim 15, wherein the plurality of first print elements are fixedly secured to the first print cartridge subassembly and the plurality of second print elements are fixedly secured to the second print cartridge subassembly.

17. The device of claim 14, wherein the first base is substantially identical to the second base, and the plurality of first print elements are substantially identical to the plurality of second print elements.

18. The device of claim 14, wherein the first base and the second base face the same direction.

19. The device of claim 14, wherein the first print cartridge subassembly and the second print cartridge subassembly face in the same direction.

20. The device of claim 14, wherein the plurality of first nozzle arrays each eject a black ink composition and the plurality of second nozzle arrays each eject an ink composition other than a black ink composition.

21. A print carriage assembly comprising:

a frame;

a first print cartridge subassembly including a first base secured to the frame and a plurality of first print elements secured to the first base, each of the first print elements including a first nozzle array adapted to eject an ink composition, the plurality of first print elements being spaced apart along a carriage scan axis and being offset along a media feed axis; and a second print cartridge subassembly including a second base secured to the frame and a plurality of second print elements secured to the second base, each of the second print elements having a second nozzle array adapted to erect an ink composition, the plurality of second print elements being spaced apart along the carriage scan axis and being offset along the media feed axis;

wherein the first base has a first edge and a second edge, and the first edge extends at a first acute angle from the second edge; the second base has a third edge and a fourth edge, and the third edge extends at a second acute angle from the fourth edge; and the first base is positioned to face the second base such that the first edge and the third edge are substantially parallel and adjacent, and the second edge and the fourth edge are substantially parallel.

22. The device of claim 21, wherein at least a portion of the first base overlaps at least a portion of the second base along the media feed axis.

23. The device of claim 22, wherein at least a portion of the first base overlaps at least a portion of the second base along the carriage scan axis.

24. The device of claim 21, wherein at least one of the first nozzle arrays overlaps at least one of the second nozzle arrays along the media feed axis.

25. The device of claim 21, wherein at least one of the first nozzle arrays overlap at least one of the second nozzle arrays along the carriage scan axis.

26. The device of claim 21, wherein at least one of the first nozzle arrays overlaps at least one of the second nozzle arrays along the media feed axis and at least another one of the first nozzle arrays overlaps at least another one of the second nozzle arrays along the carriage scan axis.

* * * * *